US005676522A

United States Patent [19]

Pommel et al.

[11] Patent Number: 5,676,522

[45] Date of Patent: Oct. 14, 1997

[54] SUPERSONIC DISTRIBUTOR FOR THE INLET STAGE OF A TURBOMACHINE

[75] Inventors: Frédéric Pommel, Valdoie; Andréas Von Kaenel, Bois Jerome; Jacques DesClaux, Andernos; Georges Meauze, Paris; Gilles Billonnet, Montrouge, all of France

[73] Assignee: Societe Europeenne de Propulsion, Suresnes, France

[21] Appl. No.: 577,388

[22] Filed: Dec. 22, 1995

[30] Foreign Application Priority Data

Dec. 27, 1994 [FR] France ..... 94 15693

[51] Int. Cl.[6] ..... F01D 1/02

[52] U.S. Cl. ..... 415/181

[58] Field of Search ..... 415/181, 914

[56] References Cited

U.S. PATENT DOCUMENTS

| | | | |
|---|---|---|---|
| 3,156,407 | 11/1964 | Bourquard | 415/181 |
| 3,333,817 | 8/1967 | Rhomberg | 415/181 |
| 4,408,957 | 10/1983 | Kurzrock et al. | 415/181 |
| 4,968,216 | 11/1990 | Anderson et al. | 415/181 |
| 5,277,549 | 1/1994 | Chen et al. | 415/181 |

FOREIGN PATENT DOCUMENTS

| | | | |
|---|---|---|---|
| 2560287 | 8/1985 | France . | |
| 1426789 | 4/1970 | Germany . | |
| 2002348 | 7/1970 | Germany . | |
| 141276 | 7/1953 | Sweden | 415/181 |
| 21322 | 12/1914 | United Kingdom . | |
| 1420318 | 1/1976 | United Kingdom . | |

OTHER PUBLICATIONS

"Thermische Turbomaschinen," Walter Traupel, Erster Band Thermodynamish–stromungstechnische Berechnung, Berlin, pp. 108–109; 305; 333–335.

*Primary Examiner*—John T. Kwon

*Attorney, Agent, or Firm*—Weingarten, Schurgin, Gagnebin & Hayes LLP

[57] ABSTRACT

The supersonic distributor for the inlet stage of a turbomachine comprises an outer case, a hub, and a set of peripheral blades disposed in a ring and attached to the hub to provide supersonic speed fluid passages between the blades to transform a flow at high pressure and low speed into a supersonic flow at low pressure. The blades are disposed radially in regular manner within a fluid feed torus. In a section developed on a line corresponding to a given radius, i.e. in a blade-to-blade plane, the blades define a profile in the form of a two-dimensional half-nozzle. This profile has a rectilinear upstream portion, a bulge defining a throat for accelerating the flow to a Mach number equal to 1, the throat being of section that varies with radius, and a downstream portion which terminates in a region of uniform flow at a trailing edge which may be truncated perpendicularly to the axis of rotation.

13 Claims, 4 Drawing Sheets

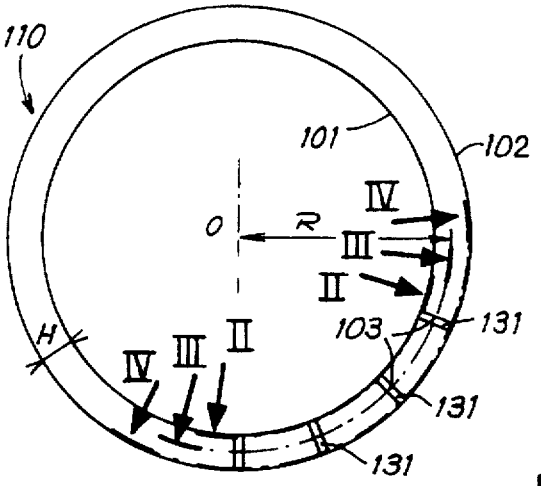
FIG. 1
FIG. 2
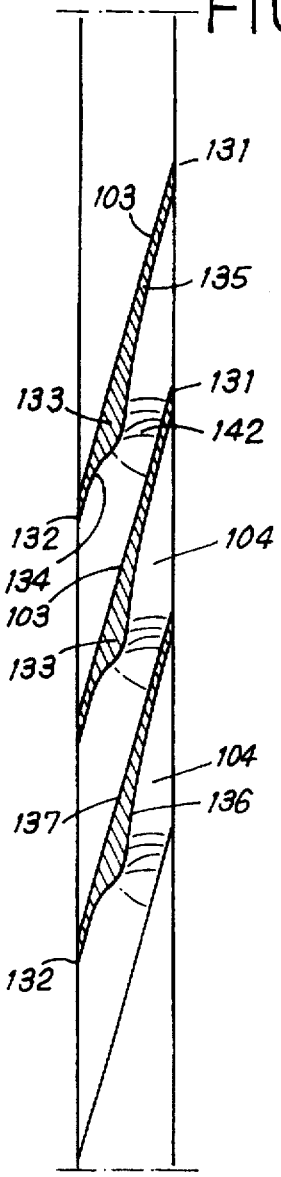
FIG. 3
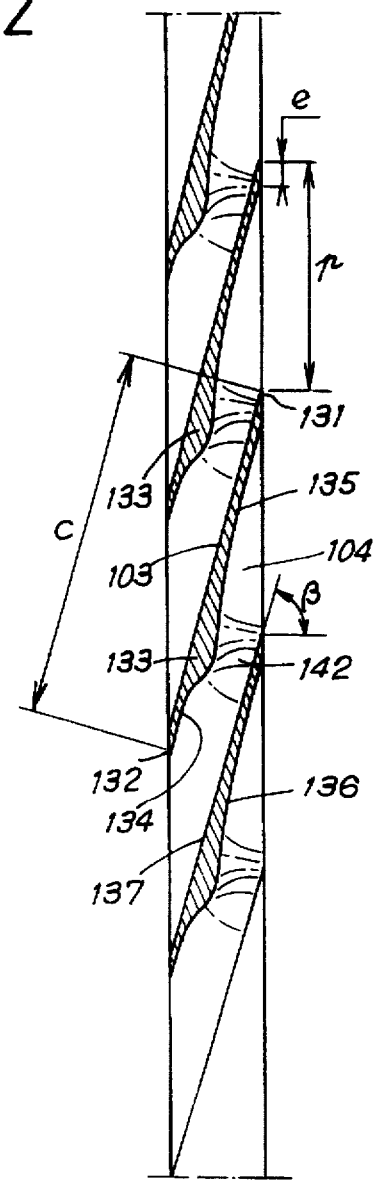
FIG. 4
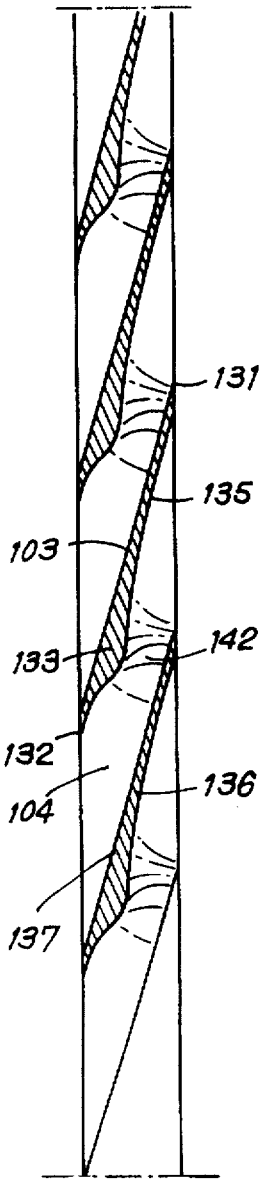

FIG.7
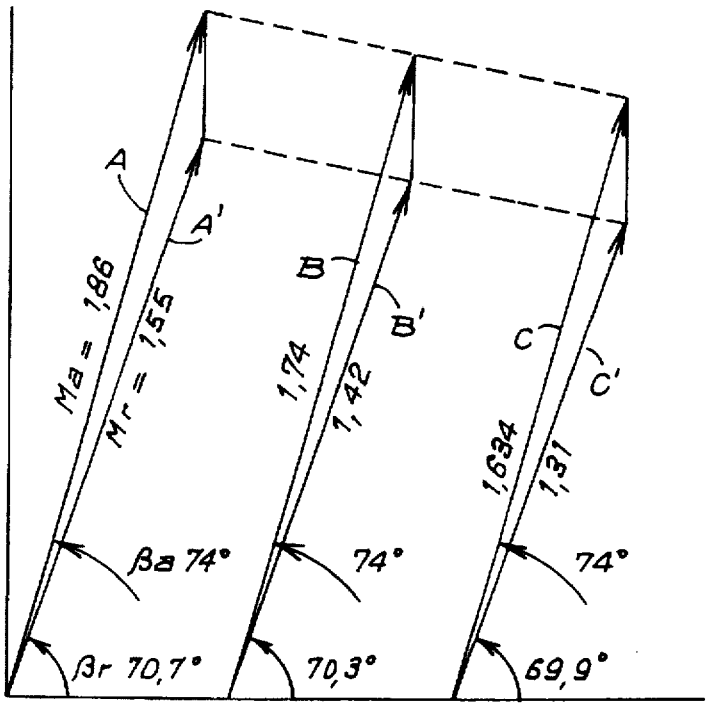
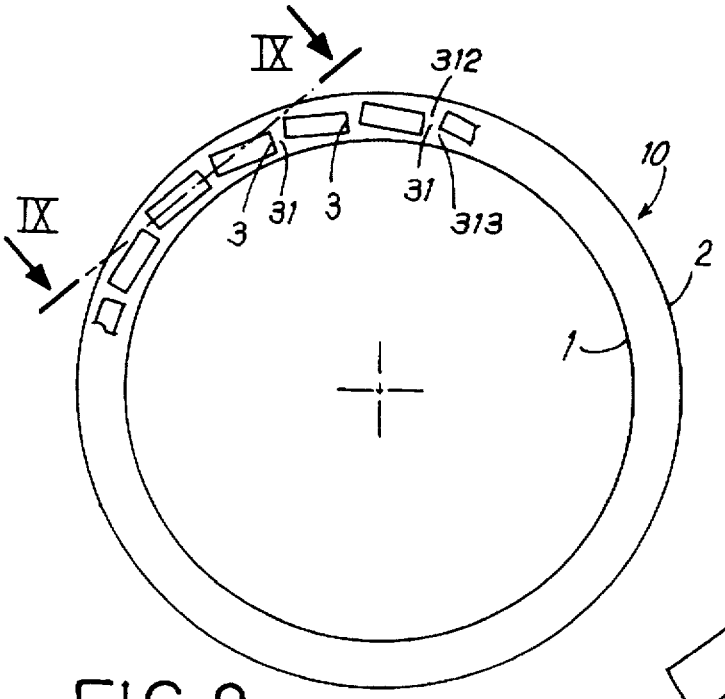
FIG.8
PRIOR ART
FIG.9
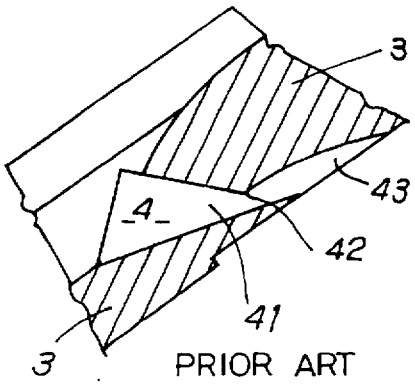
PRIOR ART

SUPERSONIC DISTRIBUTOR FOR THE INLET STAGE OF A TURBOMACHINE

FIELD OF THE INVENTION

The present invention relates to the field of turbomachines, and more particular supersonic turbines.

REFERENCE PRIOR ART

Various static types of turbine distributor are already known for guiding the driving turbine gasses towards the rotor blades of the turbine.

Thus, document FR-A-2 560 287 discloses an example of a turbine distributor for the turbopump of a rocket engine. Such a fixed annular stator nozzle or "distributor" has a certain number of fins at a spacing and with a configuration suitable for spreading and directing the flow of gas in the desired manner towards the blades. In the device described in document FR-A-2 560 287, each fin has a hollow core in order to reduce thermal stresses and it may be made of a ceramic that is injection-molded or of a refractory metal that is injected-molded, cast, or machined. Each fin has horn-shaped outer and inner plates to which the body of the fin is attached. In addition, a floating support device for the fins is designed to enable each fin to adjust itself relative to the fluid flow direction. Such a disposition is complex to make and its geometry gives rise to large stresses on the fins.

Bladed supersonic distributors are also known for the first stage of a turbopump turbine, in particular for pumping the fuel components of rocket engines, and they are made as a single block serving to transform a high pressure flow at low speed into a high speed supersonic flow with a large tangential component for feeding the first moving wheel of the turbine.

In one such distributor fed by the inlet volute of the turbine, in which gas flows at low speed, the blades of the distributor constitute a series of two-dimensional supersonic nozzles machined out of the solid and distributed periodically around a ring in planes that are tangential to the mean meridian surface of each cylindrical stream.

An example of such a conventional bladed supersonic distributor is illustrated in FIGS. 8 to 11 of the accompanying drawings.

FIG. 8 shows the configuration of such a conventional distributor 10 in its outlet plane. A cutaway portion shows the ends 31 of the blades 3 close to the outlet plane, which blades are attached both to the hub 1 and to the outer case 2 by enlarged portions 312, 313.

FIG. 9 is a section on a larger scale on line IX—IX of FIG. 8 in a plane that is tangential to the distributor. FIG. 9 shows the shape of the through passage of a single two-dimensional nozzle 4 having a diverging portion 43.

FIG. 10 is a perspective view of a portion of the distributor of FIG. 8, and FIG. 11 is a section through the portion shown in FIG. 10 in a zone close to the trailing edge. In FIG. 11, it can be seen that a blade 3 has a central portion 311 attached to the hub 1 and to the outer case 2 via portions 312 and 313 that give rise to sudden changes in thickness where mechanical stresses accumulate, as symbolized by arrows 314 and 315.

A distributor of the kind shown in FIGS. 8 to 11 suffers from a certain number of drawbacks.

In particular, the outlet flow is tangential and does not include gyration compatible with the radial balancing that it is desirable to obtain upstream from the moving wheel.

The tangential flow strikes the outer case of the moving wheel and generates shock waves that run the risk of separation at the inlet of the moving wheel.

Supersonic bottoming and stepping effects are superposed on the above phenomenon at the outlet of the distributor.

A tangential bladed distributor of the kind described above has thick three-dimensional trailing edges with stepping between the side walls of the individual nozzles and the cases of the moving wheel. High degrees of distortion therefore exist in the flow in both the radial and the azimuth directions. In particular, large deterioration has been observed in the total pressure averaged in the azimuth direction close to the outer case, which degradation reveals the presence of separation at the outer case.

OBJECT AND BRIEF DESCRIPTION OF THE INVENTION

An object of the present invention is to remedy the drawbacks of prior art bladed supersonic distributors, and in particular to enable a supersonic speed to he obtained at the outlet from the distributor that satisfies the requirement for radial balancing at the inlet to the first turbine rotor so as to ensure a good speed profile over the full height of the sets of blades.

These objects are achieved by a supersonic distributor for the inlet stage of a turbomachine, the distributor comprising an outer case, a hub, and a set of peripheral blades disposed in a ring and attached to the hub, leaving supersonic speed fluid passages between the blades to transform a flow at high pressure and low speed into a supersonic flow at low pressure, wherein:

the blades are disposed radially in regular manner within a fluid feed torus;

the blades define a profile in a section developed on a line corresponding to a given radius, i.e. in a blade-to-blade plane, which profile is in the form of a two-dimensional half-nozzle; and said profile has a rectilinear upstream portion, a bulge defining a throat for accelerating the flow to a Mach number equal to 1, the throat having a section that varies as a function of the radius under consideration, and a curved downstream portion which terminates in a region of uniform flow at a trailing edge which may be truncated perpendicularly to the axis of rotation.

The position of the bulge on each blade and the length of the curved downstream portion are defined as a function of the desired pressure ratio across the distributor.

The profile of the blades in the radial direction is built up by stacking while ensuring that the profile remains geometrically similar with a scale factor substantially equal to the ratio of the radius under consideration over the mean radius of the stream.

For each radius, the outlet angle of the distributor is adjusted by each blade being twisted between its root and its top.

A fine trailing edge is maintained over the full height of each blade. The ratio between the section of the nozzle throat and the outlet section is chosen at each radius as a function of the desired pressure ratio in such a manner as to satisfy a relationship for radial balancing.

Advantageously, the trailing edge of each blade represents 4% to 8% of the pitch defined between successive blades.

The blades have a profile that varies with radius and that is free from angular portions, except for the trailing edges and the leading edges which may advantageously be truncated.

The blades are manufactured separately and are fitted to the hub.

In one possible particular embodiment, the blades are anchored in the hub and in the outer case by portions that are Christmas-tree shaped.

The distributor of the invention may be made using powder metallurgy technology.

In a distributor of the invention, the blades are adapted to define an outlet supersonic flow lying in the range Mach 1.2 to Mach 2.5.

The distributor of the invention is particularly adapted to a turbopump turbine.

Advantageously, in the context of such an application, the blades have an outlet inclination lying in the range 65° to 80° relative to the axis of the distributor.

It will be observed that in all cases the shape of the distributor of the invention makes it possible to obtain an outlet supersonic speed that satisfies radial balancing and that ensures the inlet stream of the first rotor is fed completely.

Since the flow is naturally gyratory, losses associated with the interaction between the supersonic flow and the outer case are eliminated.

In addition, with a distributor of the invention, bottoming effects are reduced since they stem only from the thicknesses of the trailing edges.

The greater structural uniformity of the blades of a distributor of the invention is also most advantageous insofar as it eliminates sudden changes in thickness which would otherwise favor stress accumulation.

BRIEF DESCRIPTION OF THE DRAWINGS

Other characteristics and advantages of the invention appear from the following description of particular embodiments, given as examples, with reference to the accompanying drawings, in which:

FIG. 1 is a front view of a supersonic distributor of the invention;

FIGS. 2, 3, and 4 are sections respectively on lines II—II, III—III, and IV—IV of FIG. 1, showing the profiles of the blades of the distributor of the invention and corresponding to sections through the roots, through the middles, and through the tops of the blades;

FIG. 7 shows velocity triangles at the outlet from a distributor of the invention, respectively level with the root, the middle, and the top of the distributor;

FIG. 8 is a cutaway front view of a prior art supersonic distributor made as a single piece;

FIG. 9 is a section on a larger scale on line IX—IX of FIG. 8;

MORE DETAILED DESCRIPTION

FIG. 1 is an overall view of a supersonic distributor 110 of the invention comprising a set of blades 103 distributed between a hub 101 and an outer case 102.

It can be seen that the blades 103 are radially disposed in regular manner in a ring occupying a fluid feed torus.

Figure 5:
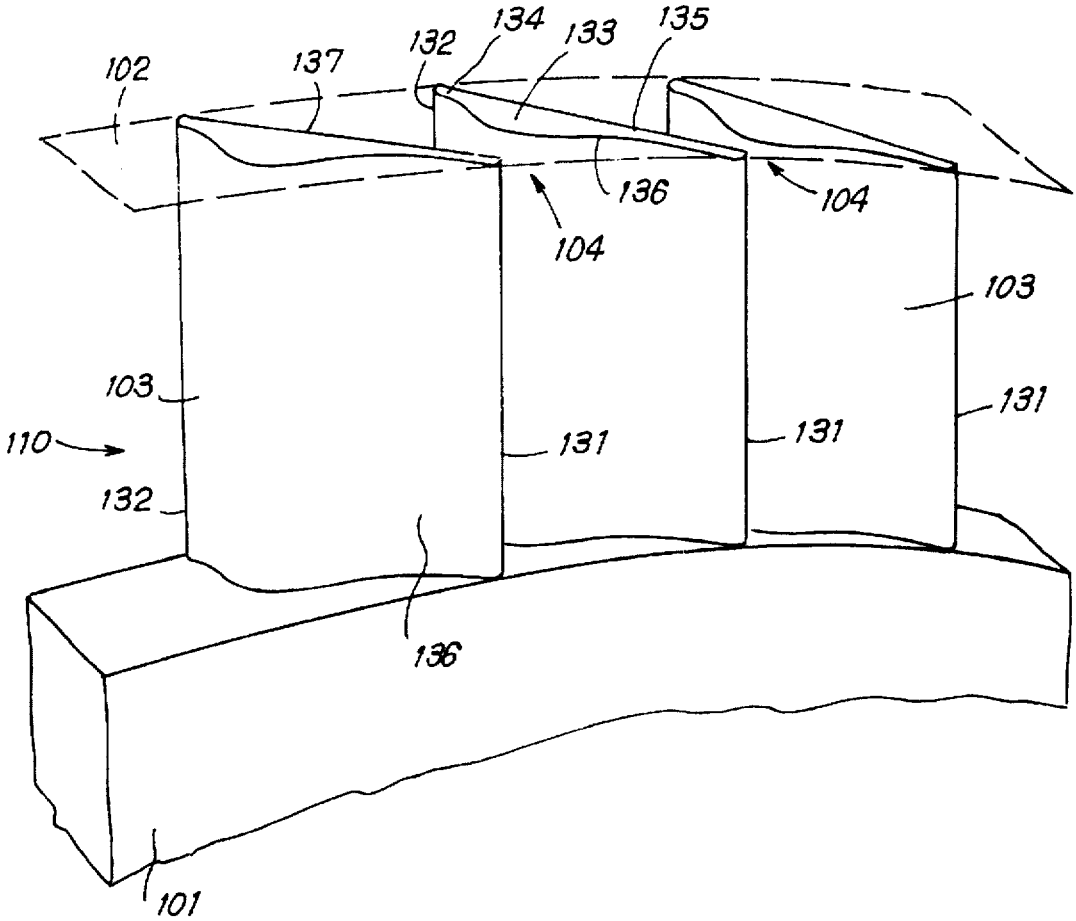
FIG. 5 is a fragmentary perspective view showing one example of the overall shape of the blades of a distributor of the invention.
Figure 6:
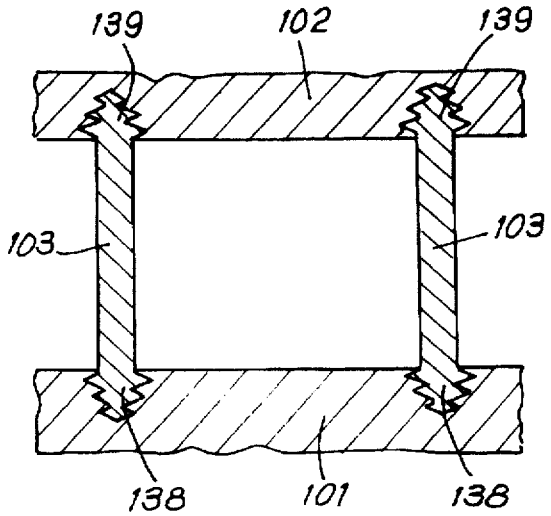
FIG. 6 is a section in a plane parallel to the outlet plane, showing a particular example of how the blades are anchored in the hub and in the outer case.
Figure 10:
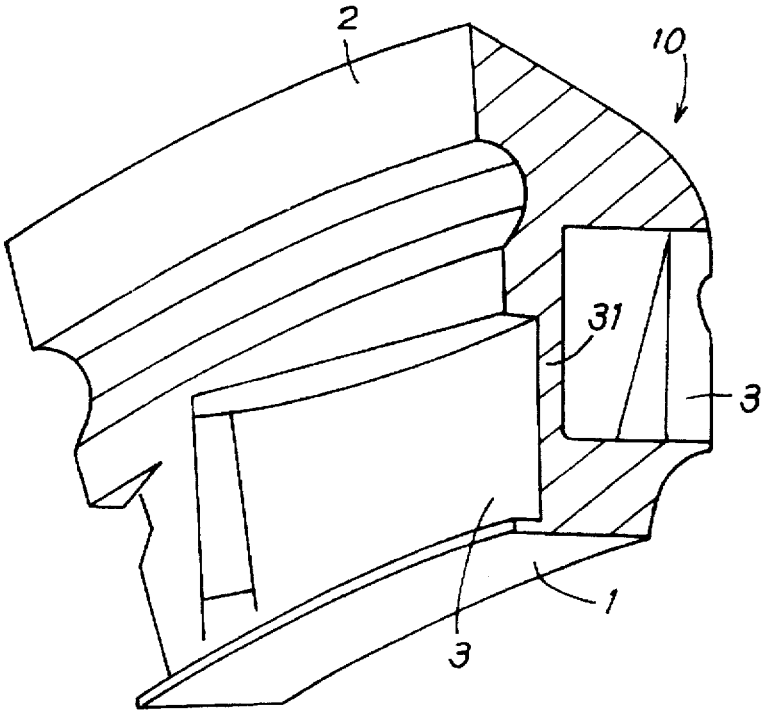
FIG. 10 PRIOR ART
FIG. 10 is a fragmentary perspective view of the known distributor of FIG. 8.
Figure 11:
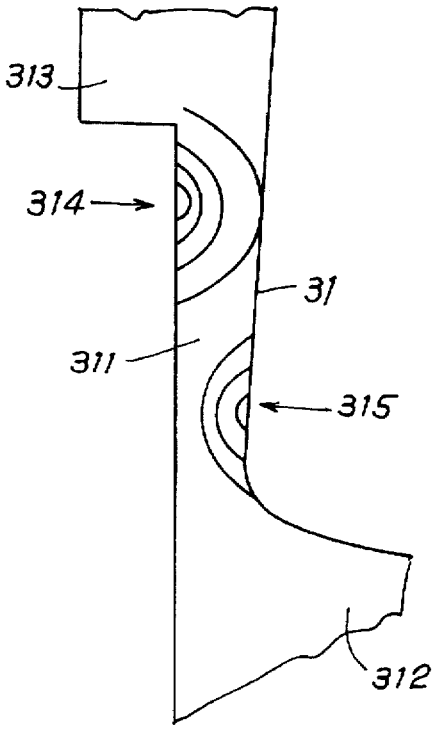
FIG. 11 PRIOR ART
FIG. 11 is a section through a blade of the distributor of FIGS. 8 and 10, close to its outlet plane.

FIGS. 2 to 5 show the fluid passages 104 formed between the blades 103, having leading edges and trailing edges respectively referenced 132 and 131.

In a section developed on a given radius, e.g. in a section at root level (FIG. 2), at middle level (FIG. 3) and at top level (FIG. 4), the blades 103 define a profile in the form of a two-dimensional half-nozzle.

The profile of each blade 103 in a blade-to-blade plane such as those of FIGS. 2 to 4 has a rectilinear upstream portion 134, a bulge 133 defining a throat 142 for accelerating the flow to Mach=1, and a curved downstream portion 135 which terminates in a region of uniform flow at a fine trailing edge 131 which may be truncated perpendicularly to the axis of rotation.

Each blade 103 has a wall 136 defining a half-nozzle and a wall 137 without a bulge. Two successive blades 103 define between them a fluid passage 104 defined firstly by a wall 137 that does not bulge and secondly by a wall 136 that forms a half-nozzle, thereby generating a supersonic flow which may have a Mach number at its outlet lying in the range Mach=1.2 to Mach=2.5, approximately.

The flow having a Mach number of 1 at the throat 142 is accelerated progressively downstream until it reaches the outlet of the flow channel 104.

The position of the bulges 133 defining the throats 142 of the nozzles, and also the length of the downstream sections 135 of the blades 103 are defined as a function of the pressure ratio desired across the distributor.

The profile of the blades of the distributor 110 of the invention is characterized in particular by the presence of a leading edge 132 that is fine, and above all of a trailing edge 131 that is also fine. Thus, the thickness e of the trailing edge 131 may lie in the range 4% to 8% approximately of the pitch p defined between successive blades 103 (FIG. 3).

A trailing edge thickness e of about 6% of the pitch p is in general satisfactory for limiting the level of losses and for improving the quality of the flow.

The profile of a blade 103 in the radial direction of the height H of the blade is constructed by stacking while maintaining geometrical similarity for the profile with a scale factor substantially equal to the ratio of the radius in question over the mean radius R of the stream.

For each radius, the outlet angle from the distributor is adjusted by twisting the blades 103 between their roots 101 and their tops 102. This is performed in such a manner as to ensure that the Mach triangle at the inlet of the moving wheel varies radially.

In all cases, the varying profile of the blades 103 is such that the blades are free from angular portions with the exception of the leading and trailing edges which may advantageously be truncated.

The blades 103 may be manufactured separately and fitted to the hub 101. By way of example, and as shown in FIG. 7, the blades 103 may be anchored in the hub 101 and in the outer case 102 by end portions 138 and 139 that are Christmas-tree shaped.

The bladed distributor of the invention may advantageously be made using powder metallurgy technology.

The blades 103 may have various outlet inclinations depending on the intended application.

In an application to a turbopump turbine, the inclination of the blades 103 relative to the axis of the distributor may lie in the range 65° to 80°, approximately.

A particular embodiment of a supersonic bladed distributor of the invention as applied to a turbopump turbine, has the following characteristics:

mean radius R of the stream=120 mm;

height H of the blades=11.9 mm;

chord C of the blades=15.4 mm;

thickness e of the trailing edge=6.6% of the blade pitch p;

inclination of the blades relative to the axis=74° on outlet;

number of channels=31;

expansion ratio=6.5.

FIG. 7 relates to the above example and shows velocity triangles upstream from the turbine rotor at root level (vectors A, A'), at a middle radius (vectors B, B') and at top level (vectors C, C').

The vectors A, B, and C show outlet velocity magnitudes in terms of Mach number (i.e. respectively 1.86, 1.74, and 1.63) for an absolute inclination βa of 74°, for the root at the middle radius and at the tops of the blades 103.

These velocity magnitudes vary up the height of the blades to adapt to radial balancing.

The vectors A', B', and C' give the relative velocity magnitudes at the inlet to the rotor in terms of Mach number (i.e. respectively 1.55, 1.42, and 1.31) for respective relative angles βr of 70.7°, 70.3°, and 69.9° at root level, at middle radius, and at head level for the blades 103 of the distributor.

With these magnitudes, satisfactory radial balancing is obtained at the outlet of the distributor and proper speed balancing is established over the full height of the blades of the first rotor.

We claim:

1. A supersonic distributor for the inlet stage of a turbomachine, the distributor comprising an outer case, a hub and a set of peripheral blades disposed in a ring and attached to the hub, providing supersonic speed fluid passages between the blades for transforming a flow at high pressure and low speed into a supersonic flow at low pressure, wherein:

the blades are disposed radially and symmetrically within a fluid feed torus;

the blades define a profile in a section developed on a line corresponding to a given radius in the form of a two-dimensional half nozzle; and said profile has a rectilinear upstream portion, a bulge defining a throat for accelerating the flow to a Mach number equal to 1, the throat having a section that varies as a function of the radius under consideration, and a curved downstream portion which terminates in a region of uniform flow at a trailing edge which is truncated perpendicularly to the axis of rotation.

2. The distributor according to claim 1, wherein the position of the bulge on each blade and the length of the curved downstream portion are defined as a function of the desired pressure ratio across the distributor.

3. The distributor according to claim 1, wherein the profile of the blades remains geometrically similar with a scale factor substantially equal to the ratio of the radius under consideration over the mean radius of the stream.

4. The distributor according to claim 1, wherein for each radius the outlet angle of the distributor is adjusted by each blade being twisted between its root and its top.

5. The distributor according to claim 1, wherein a fine trailing edge is maintained over the full height of each blade as is a ratio between the section of the nozzle throat and the outlet section which is chosen at each radius as a function of the desired pressure ratio.

6. The distributor according to claim 1, wherein the trailing edge of each blade represents approximately 4% to approximately 8% of a pitch defined between successive blades.

7. The distributor according to claim 1, wherein the blades have a profile that varies with radius and that is free from angular portions.

8. The distributor according to claim 1, wherein the blades are manufactured separately and are fitted to the hub.

9. The distributor according to claim 1, wherein the blades are anchored in the hub and in the outer case by portions that are Christmas-tree shaped.

10. The distributor according to claim 8, made using powder metallurgy technology.

11. The distributor according to claim 1, wherein the blades are adapted to define an outlet supersonic flow lying in the range approximately Mach 1.2 to approximately Mach 2.5.

12. The distributor according to claim 1, adapted to a turbopump turbine.

13. A supersonic distributor for the inlet stage of a turbomachine, the distributor comprising an outer case, a hub and a set of peripheral blades disposed in a ring and attached to the hub, providing supersonic speed fluid passages between the blades for transforming a flow at high pressure and low speed into a supersonic flow at low pressure, wherein:

the blades are disposed radially and symmetrically within a fluid feed torus;

the blades define a profile in a section developed on a line corresponding to a given radius in the form of a two-dimensional half nozzle; and said profile has a rectilinear upstream portion, a bulge defining a throat for accelerating the flow to a Mach number equal to 1, the throat having a section that varies as a function of the radius under consideration, and a curved downstream portion which terminates in a region of uniform flow at a trailing edge which is truncated perpendicularly to the axis of rotation;

wherein said distributor is adapted to a turbopump turbine; and wherein the blades have an outlet inclination lying in the range of approximately 65° to approximately 80° relative to an axis of the distributor.

* * * * *